US006297593B1

(12) United States Patent
Takashige et al.

(10) Patent No.: US 6,297,593 B1
(45) Date of Patent: Oct. 2, 2001

(54) BOOSTING TRANSFORMER FOR HIGH-FREQUENCY HEATING DEVICE

(75) Inventors: Yutaka Takashige, Kishiwada; Shinichi Masuda, Tondabayashi, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/586,565

(22) Filed: Jun. 2, 2000

(30) Foreign Application Priority Data

Jun. 3, 1999 (JP) ..... 11-155881
May 26, 2000 (JP) ..... 2000-156180

(51) Int. Cl.[7] ..... H01J 25/50

(52) U.S. Cl. ..... 315/39.51; 219/760; 219/756; 336/182; 363/21.04

(58) Field of Search ..... 315/39.51, 272, 315/274, 282, 291; 219/723, 756, 760, 762; 363/21.04, 101, 84 C; 336/182, 223; 174/35 R

(56) References Cited

U.S. PATENT DOCUMENTS 4,885,445 12/1989 Taniguchi ..... 219/10.55 B
4,977,301 * 12/1990 Maehara et al. ..... 219/715
5,347,109 * 9/1994 Nakabayashi et al. ..... 219/716
5,604,405 * 2/1997 Ogura ..... 315/39.51

FOREIGN PATENT DOCUMENTS 0318695 6/1989 (EP) .
62-58011 0 U 4/1987 (JP) .
01130492 5/1989 (JP) .

* cited by examiner

*Primary Examiner*—Haissa Philogene

(57) ABSTRACT

A boosting transformer for a high-frequency heating apparatus includes an insulation member, and a primary winding and a secondary winding formed at the insulation member and mutually isolated by the insulation member, each winding having a width and a thickness as measured when the winding is stacked, the width being smaller than the thickness. As such, the boosting transformer can be reduced in height to readily ensure a distance for insulating locations having therebetween a large potential difference from each other in the transformer's internal structure in designing a structure in which the transformer is attached to a high-frequency heating apparatus. Thus the boosting transformer can be attached to the high-frequency heating apparatus at a location less restrictively and such designing can be facilitated.

13 Claims, 14 Drawing Sheets

BOOSTING TRANSFORMER FOR HIGH-FREQUENCY HEATING DEVICE

BACKGROUND OF THE INVENTION

1. Field of the Invention

The present invention relates to boosting transformers used in high-frequency heating devices.

2. Description of the Background Art

Conventional Art

Conventionally, high-frequency heating devices such as microwave ovens have used a boosting transformer configured as shown in FIG. 19. Such conventional transformer first of all has a winding including a primary winding 20 and a secondary winding 21 and a filament winding 23. These windings are coupled together via a magnetic circuit formed of a magnetic body in the form of two ferrite cores 24. As shown in the FIG. 19 cross section, windings 20, 21, 23 are each arranged in the direction of the height of the boosting transformer, i.e., the lateral direction in the figure. Primary winding 20 has a width in the direction of the height of the boosting transformer W1 and a thickness as measured when the winding is stacked T1, wherein width W1≧thickness T1, and secondary winding 21 also has a similar width-thickness relationship.

As such, the boosting transformer is sized to have a height large relative to its width and depth. This has been a limitation in determining where such boosting transformer should be attached in a high-frequency heating device which is complicated and has a high voltage line arranged therein and also has a complicated internal structure.

If the secondary winding has an insufficiently divided width, a problem will occur as described below: normally, the secondary winding receives a high voltage, which is, between the top and end of the winding, an instant, maximal voltage of 6 kv to 10 kv. As shown in FIG. 21, secondary winding 21 is successively wound around an insulation member 25 in the direction of the arrow and thus successively stacked, and it completes when it reaches a winding count as defined. If secondary winding 21 is provided as described above, however, secondary winding 21 provided through such process will inevitably have a portion failing to align and thus displaced.

In providing a secondary winding, as described above, the winding is labeled V0 at its top, V1, V2, . . . at its return points and V9 at its end, as shown in FIG. 21. As such, if the secondary winding is provided in alignment, the winding normally has the V9 position adjacent to the V7 position. However, if at the ending, V9 position the winding is displaced down from its appropriate layer level, the displaced winding will be processed adjacent to the winding positioned at V5 or V3. If a winding have such displacement, in proportion to the number of such displacements the winding will receive a voltage twice to triple a voltage which a winding provided in alignment would receive.

Conventionally, a secondary winding has been divided normally into two to three blocks to reduce its width W to prevent any significant displacement thereof and thus reduce a voltage that would otherwise be applied.

In a boosting transformer, each winding and a magnetic body must be insulated from each other. To achieve such insulation, insulation members 25, 26 are provided as shown in FIG. 19. Insulation member 25 is structured to provide a plurality of protruding, dividing walls surrounding primary winding 20, secondary winding 21 and filament winding 23 to insulate such windings from each other and also divide the high-voltage generating, secondary winding normally into two to three blocks, as described above (in FIG. 19, three blocks). Insulation member 25 thus structured results in the transformer having an increased height. Insulation member 26 insulates windings 20, 21, 23 and core 24 from each other.

Furthermore, in providing the aforementioned magnetic circuit to provide a permeability adjusted to match the circuit's operating state, insulation members 25, 26 are structured to allow ferrite core 24 to have a gap 22. As a result, when the boosting transformer operates a magnetic flux varies and ferrite core 24 thus oscillates and produces a noise. Accordingly, to prevent such noise a core fixing band 27 or an adhesive or the like must be used to fix ferrite core 24 to reduce the noise. This degrades the workability and reliability of the transformer and increases the cost for the same.

Furthermore, conventionally a boosting transformer is assembled through a procedure as shown in FIG. 20, having the following steps:

in a first step, primary winding 20, secondary winding 21 and filament winding 23 are successively wound around insulation member 25;

in a second step, insulation member 26 is attached to insulation member 25;

in a third step, two cores 24 are inserted into the combination of insulation members 25 and 26;

in a fourth step, core fixing band 27 is attached to fix ferrite core 24; and in a fifth step, the above is soldered to a temporarily fixed terminal to complete a boosting transformer.

Since such assembling procedure is taken, to produce a boosting transformer each winding must be wound around an insulation member or it could not have a magnetic material attached thereto. As such, in its production the boosting transformer must be processed through a carefully considered procedure and it is thus produced inefficiently

SUMMARY OF THE INVENTION

To overcome the conventional disadvantage described as above, one object of the present invention is to provide a boosting transformer sized and shaped to have its height reduced relative to its width and depth to be readily accommodated internal to a high-frequency heating device having a high-voltage line arranged therein and a complicated structure.

Another object of the present invention is to provide an approach for eliminating a noise produced when a ferrite core oscillates in operating a boosting transformer, and also to prevent such approach from degrading the workability and reliability of the boosting transformer and increasing the cost for the same.

Still another object of the present invention is to produce a boosting transformer through a process having steps simplified to produce the same more efficiently.

In order to achieve the above objects, the present invention provides a boosting transformer for a high-frequency heating device to overcome such disadvantages as resulting from conventional systems, having a configuration, function and effect as described below.

In the present invention, a boosting transformer for a high-frequency heating device is used in a high-frequency heating device configured to rectify a commercial, alternating power supply to obtain a direct-current voltage which is in turn converted by an inverter circuit to a high-frequency voltage which is in turn boosted by a boosting transformer and thus supplied to a magnetron. The boosting transformer includes an insulation member, and a primary winding and a secondary winding provided on the insulation member and mutually insulated by the insulation member. The present invention is characterized in structure in that the primary winding and the secondary winding each have a width (W1, W2) and a thickness as measured when each winding is stacked (T1, T2), the width (W1, W2) being smaller than the thickness (T1, T2).

Thus, the primary winding and the secondary winding, having an significant effect in shaping the boosting transformer, can be shaped flat to allow the transformer to be readily attached internal to a high-frequency heating device having a high-voltage line arranged therein and a complicated structure.

Furthermore, reducing a winding in width allows the winding to receive a reduced voltage for each layer thereof if the secondary winding is not divided when it is provided. As such, if a secondary winding receiving a high voltage fails to align and is thus displaced down as it is provided, it would only have a reduced inter-winding potential difference. As such, it can hardly suffer an inter-winding dielectric breakdown and the boosting transformer can thus be enhanced in reliability.

Furthermore, providing a boosting transformer with a primary winding and a secondary winding reduced in width (W1, W2) and increased in thickness as measured when each winding is stacked (T1, T2), allows the windings to be adjacent to each other over an increased area and thus magnetically coupled together more significantly. As such, a gap conventionally provided in a core of a magnetic body for adjusting a magnetic circuit in permeability, may be moved to any location as desired. As such, the magnetic circuit can be set, as desired, to match the shape of the boosting transformer, with a magnetic material added to an insulation member for insulating a winding, a magnetic body attached to such insulation member, or the like.

In the present invention preferably the boosting transformer for a high-frequency heating device has the secondary winding not divided but provided in a single block.

In one embodiment of the present invention, the insulation member is provided in the form of a bobbin having a center with a throughhole passing therethrough and the insulation member has an internal portion of the throughhole and a portion of an external surface thereof which are continuously surrounded by a ferrite core corresponding to a magnetic body for providing a magnetic circuit.

In another embodiment of the present invention, the insulation member may have a magnetic material added thereto to also serve as a magnetic body providing a magnetic circuit.

Such integration of the insulation member and the magnetic body can eliminate a source of a noise caused when the magnetic body oscillates in operating the boosting transformer. Thus it is not necessary to take an approach for noise reduction, such as using a core fixing band or adhesive to fix the magnetic body to the insulation member.

Conventionally, in fabricating a boosting transformer each winding must be wound around an insulation member or it would not be able to have a magnetic material attached thereto. As such, the boosting transformer would not be fabricated efficiently. In contrast, if the insulation member may have a magnetic body added thereto, then the insulation member may have the magnetic body added thereto at any step of the process of each winding and a magnetic circuit can be set as desired to match the shape of the boosting transformer. Thus, in its production the boosting transformer can be processed through a simple process and it can thus be produced more efficiently.

In the present invention preferably the boosting transformer includes the primary winding having a width (W1) and a thickness as measured when it is stacked (T1) in a relationship of $1.5<{}^{T1}/_{W1}<9$, and the secondary winding having a thickness as measured when it is stacked (T2) of no less than 0.6T1 and no more than 1.5T1, and a width (W2) having a value determined depending on the winding diameter and turn-count. Such dimensions as set as above can implement a boosting transformer for a high-frequency heating device which has a height H and a diameter D well-balanced and is also reduced in thickness and also enhanced in performance and also economical.

In the present invention according to one embodiment a magnetic body does not have an arm extending toward and circumscribing an open end of a groove of the insulation member with a winding provided therein. As such, the magnetic body can be attached to the insulation member before a winding is provided. Furthermore, if the winding is repaired, it can be repaired without removing the magnetic body.

In the present invention according to a preferable embodiment the magnetic body is buried in the insulation member. As such the present invention can be effectively advantageously used without any safety guideline imposed thereon.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 17 illustrates a structure dimensioned as in FIG. 7 on the left hand of the center line and a structure of one comparative example on the right hand of the center line, for studying in the structure of the fifth embodiment a correlation in dimension between the primary winding 20 thickness as measured when it is stacked T1 and width W1, the secondary winding 21 thickness as measured when it is stacked T2 and width W2, and the like.

FIG. 18 illustrates a structure dimensioned as in FIG. 7 on the left hand of the center line and a structure of another comparative example on the right hand of the center line, for studying in the structure of the fifth embodiment a correlation in dimension between the primary winding 20 thickness as measured when it is stacked T1 and width W1, the secondary winding 21 thickness as measured when it is stacked T2 and width W2, and the like.

DESCRIPTION OF THE PREFERRED EMBODIMENTS

Boosting transformers according to the embodiments of the present invention will now be described with reference to the drawings.

Figure 1:
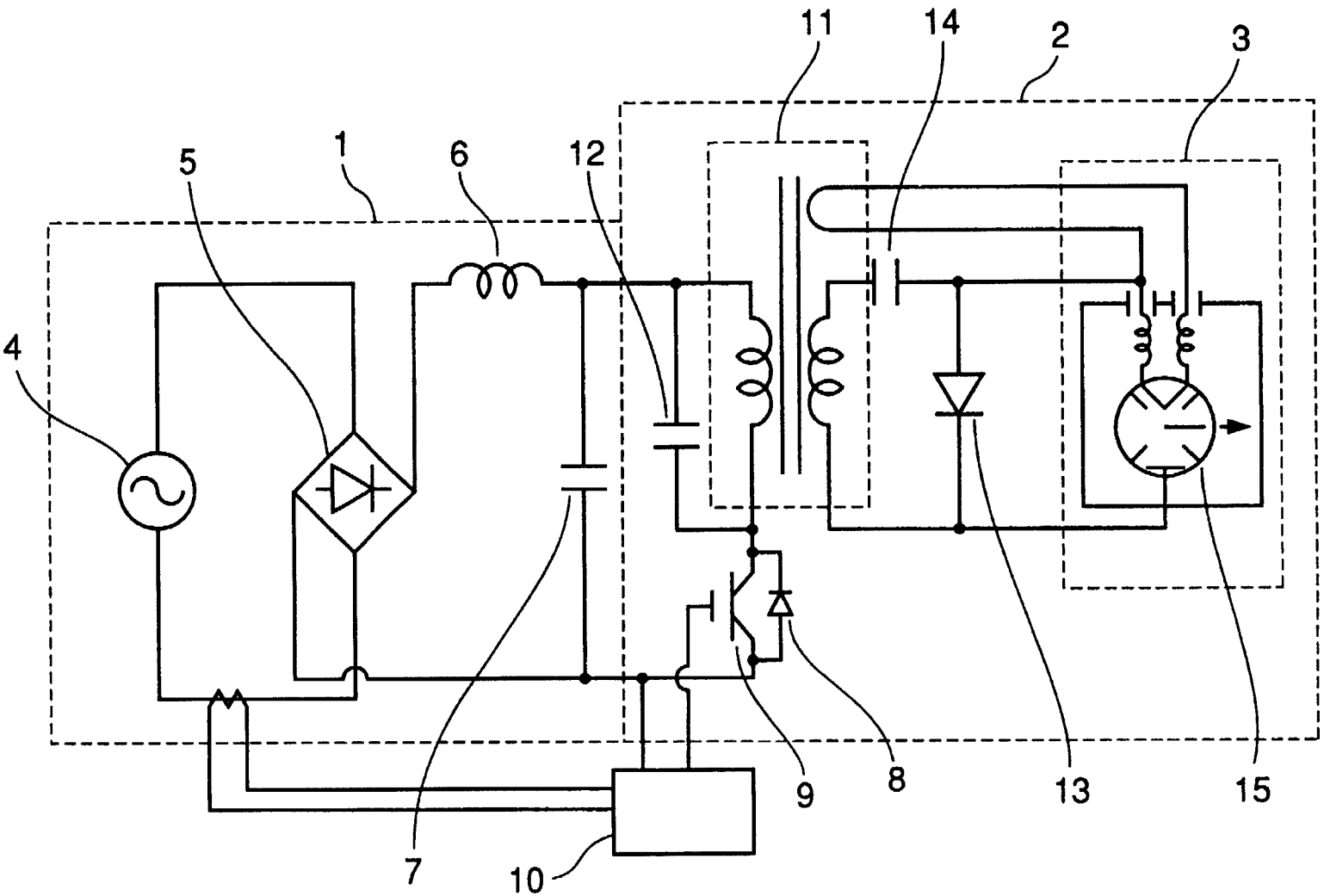
FIG. 1 is a circuit diagram showing a configuration of a high-frequency heating device with a boosting transformer of the present invention applied thereto.

FIG. 1 is a circuit diagram showing an exemplary, high-frequency heating device employing a boosting transformer of the present invention. In the FIG. 1 circuit, a power supply unit 1 includes a rectifier 5 to rectify a commercial power supply 4, and a coil 6 and capacitor 7 to smooth the rectified power supply. A power conversion unit 2 is configured of: a frequency conversion circuit formed of a semiconductor device 9, a diode 8, a boosting transformer 11 and a capacitor 12 for converting the power fed from power supply unit 1 into a high-frequency power; a high-voltage rectify circuit formed of a boosting transformer 11, a capacitor 14 and a diode 13; a high-frequency radiation unit 3 of a magnetron 15 converting a high-voltage, rectified power into a high frequency; and a control unit 10 controlling semiconductor device 9 between ON and OFF states and generally controlling the high-frequency heating device.

A description will now be provided of various embodiments of the boosting transformer of the present invention as a component of the circuit as described above.

First Embodiment

Figure 2:
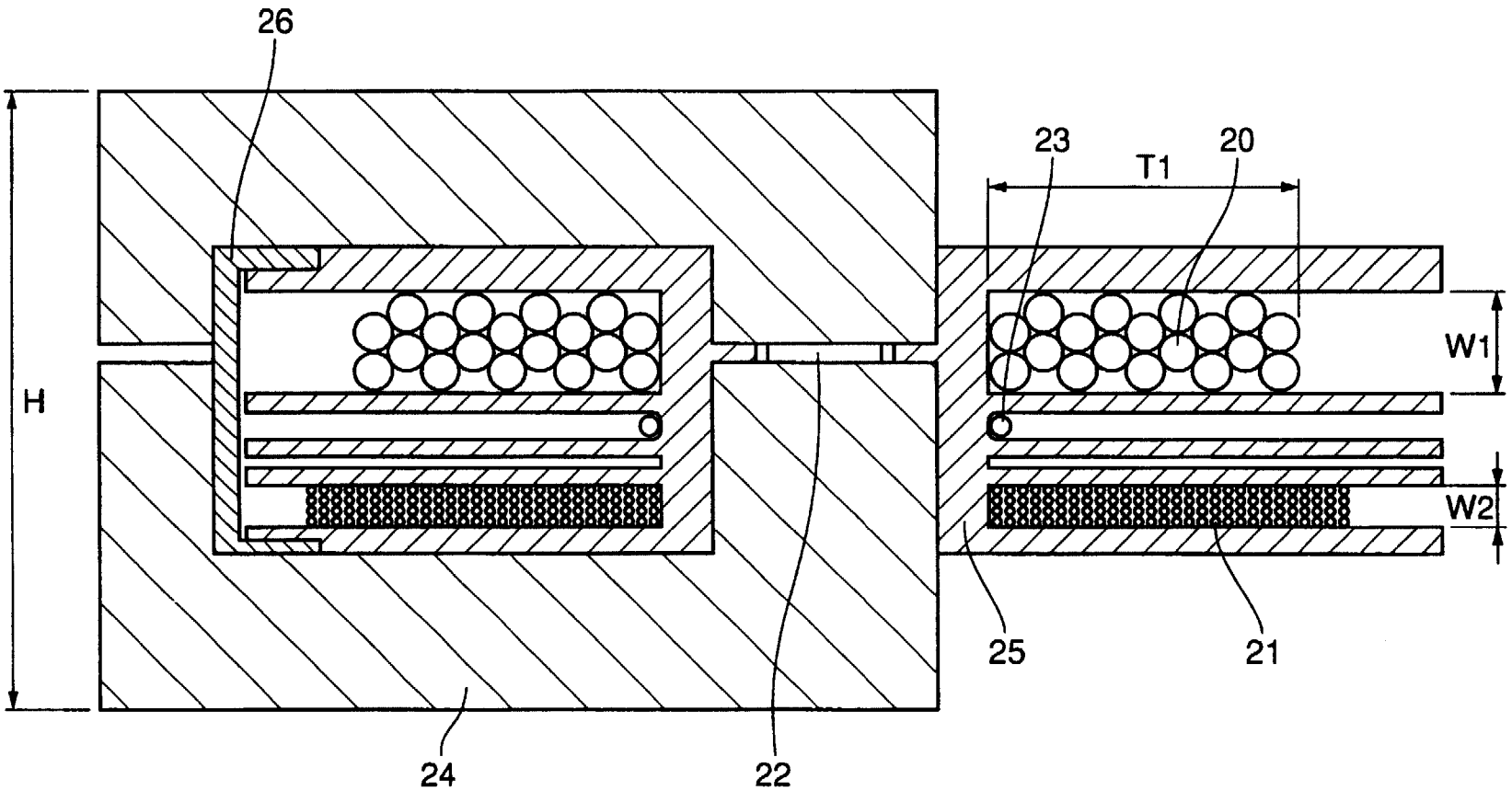
FIG. 2 is a cross section of a structure of a boosting transformer according to a first embodiment of the present invention.

FIG. 2 shows a structure of a boosting transformer according to a first embodiment of the present invention. As shown in the figure, boosting transformer 1 has a winding corresponding to a primary winding 20, a secondary winding 21 and a filament winding 23 which are wound around an insulation member 25 in the form of a bobbin and also insulated from each other by a dividing wall of insulation member 25. As a magnetic body for coupling such windings together, two, U-shaped ferrite cores 24 are arranged to pass through a center hole of the insulation member. Ferrite cores 24 form a magnetic circuit and between ferrite cores 24 a gap is provided.

As compared with a conventional boosting transformer, boosting transformer 1 has primary winding 20 having a reduced width (W1) and an increased thickness as measured when the winding is stacked (T1), and also wound flat. It is also configured to be W1<T1, with the value of T1 at least twice that of W1. The secondary winding is similar to the primary winding in the width-height relationship.

The secondary winding may have a further reduced width W2 to eliminate the necessity of dividing the winding into two to three blocks with an insulation member, as conventional, while the winding can hardly be displaced. As such, in proving a boosting transformer with a winding, the winding is hardly displaced so that if it receives a high voltage it would not have dielectric breakdown.

Figure 6:
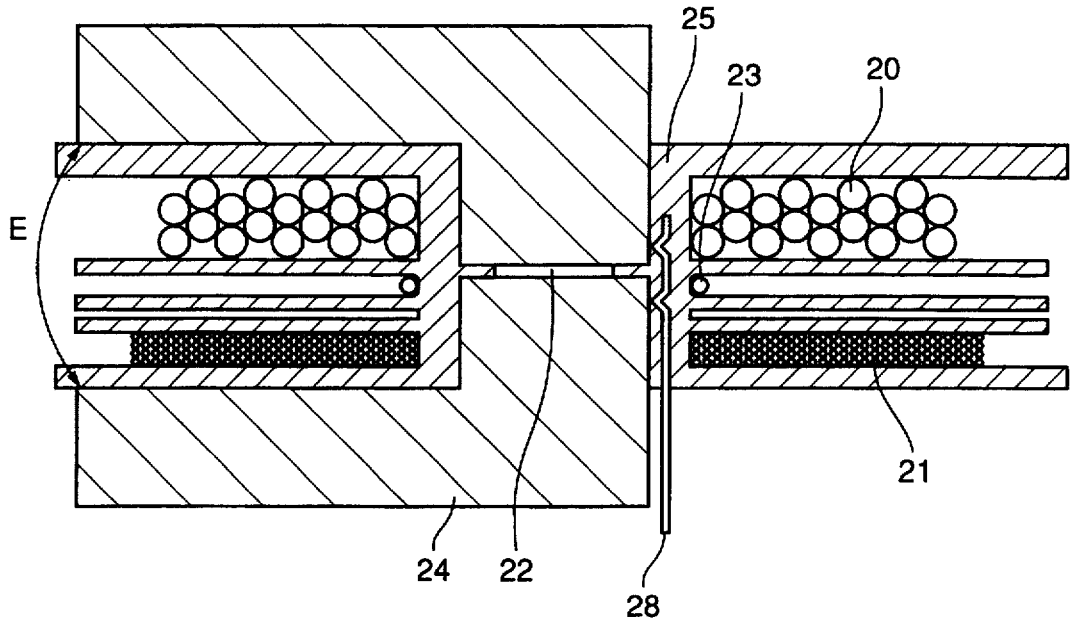
FIG. 6 is a cross section of a structure of a boosting transformer according to a fourth embodiment of the present invention.

Furthermore, insulation member 25 of the FIG. 6 conventional example with dividing walls would dispense with a dividing wall 25*a* for dividing secondary winding 21 into three. As such the boosting transformer can be reduced in height accordingly. In other words, the FIG. 2 boosting transformer can have its height H reduced while its winding can have a total cross sectional area unchanged.

Furthermore, allowing a winding to have an increased thickness as measured when the winding is stacked, also allows primary winding 20 and secondary winding 21 arranged in the direction of the height of the boosting transformer to be opposite to each other over a larger area. As a result, between the windings more magnetic flux can pass through, coupling the windings together more significantly.

Second Embodiment

Figure 3:
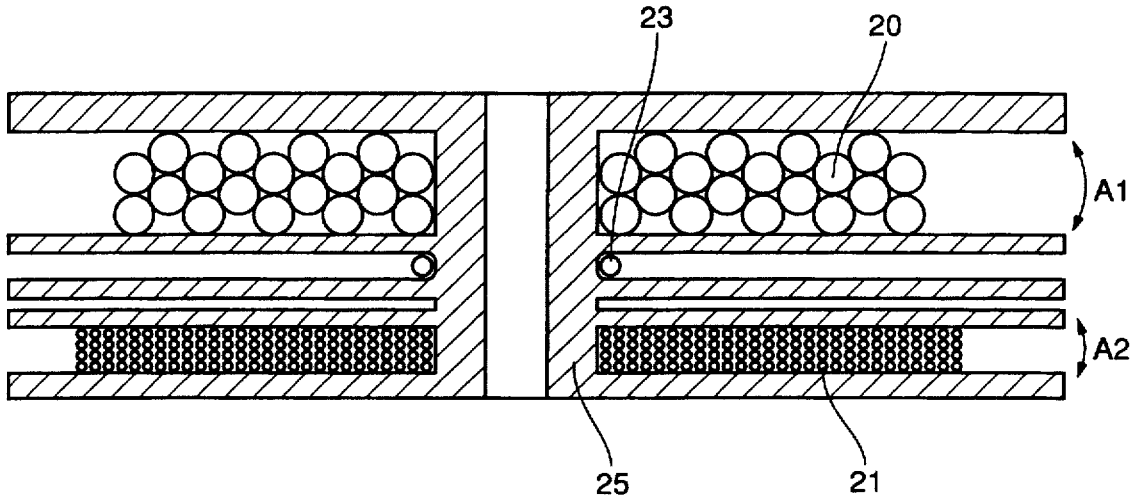
FIG. 3 is a cross section of a structure of a boosting transformer according to a second embodiment of the present invention.

Reference will now be made to FIG. 3 to describe a configuration of a boosting transformer according to a second embodiment of the present invention, making use of the aforementioned feature to dispense with a ferrite core as conventionally used. In the present embodiment, the boosting transformer includes a magnetic material added to insulation member 25 in the form of a bobbin having a dividing wall for insulating and separating each winding. Insulation member 25 with the magnetic material added thereto thus functions as an insulation member as well as a magnetic material.

In the present embodiment, a magnetic flux of the boosting transformer passes through insulation member 25 and also through air as indicated by arrows A1 and A2 and thus provides a magnetic circuit. Allowing such magnetic circuit to have a winding increased in thickness when the winding is stacked, allows primary winding 20 and secondary winding 21 to be opposite with each other over an increased area. Consequently, more magnetic flux can pass therethrough and as a so-called magnetic circuit it can be reduced in magnetic resistance.

Furthermore, providing a winding reduced in width allows primary winding 20 and secondary winding 21 to be less distant from each other. As such, the space between the windings can be provided as a gap serving to function to adjust the magnetic resistance of the magnetic circuit. Thus, the boosting transformer can dispense with a U-shaped ferrite core while as a magnetic circuit a coupling factor of approximately 0.65 to 0.8 can be set for primary winding 20 and secondary winding 21.

Furthermore in the above configuration the integration of a magnetic body for providing a magnetic circuit and an insulation member for insulating windings can eliminate a source of a noise produced when the boosting transformer operates. As such, in contrast to the conventional art as described above, if a flux varies the magnetic body does not oscillate and as a result a noise is prevented. As such, a core fixing band, adhesive and the like for reduction of such noise can also be advantageously dispensed with.

Third Embodiment

Figure 4:
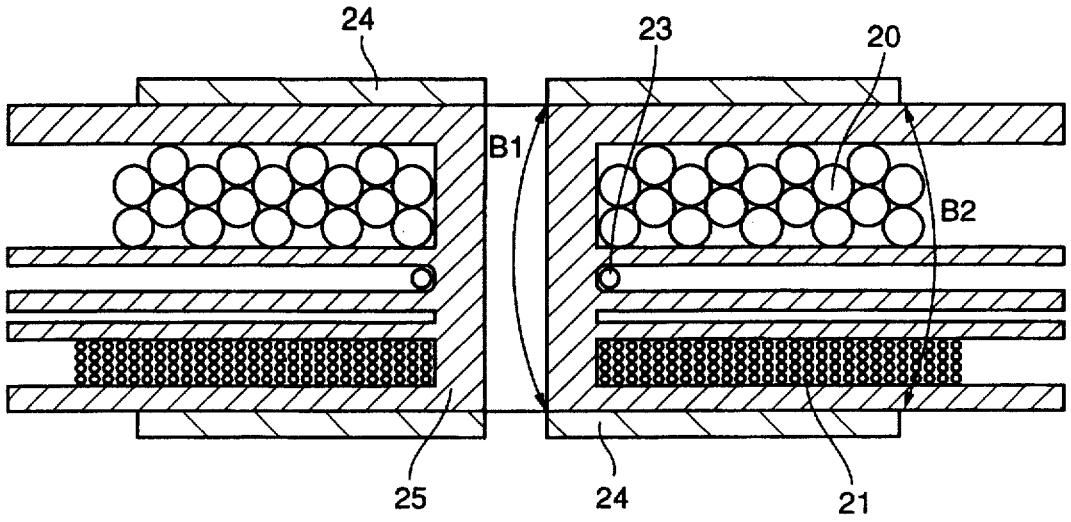
FIG. 4 is a cross section of a structure of a boosting transformer according to a third embodiment of the present invention.

Reference will now be made to FIG. 4 to describe a boosting transformer according to a third embodiment of the present invention. In the present embodiment also, as in the first and second embodiments, a boosting transformer includes primary winding 20, secondary winding 21 and filament winding 23. The present embodiment is distinguished from the first and the second embodiments in that a winding is insulated by insulation member 25 provided in the form of a bobbin having upper and lower surfaces with a magnetic body 28 in the form of a plate attached thereto for magnetically coupling the windings together. The magnetic body is shaped in a plate, such as shown in FIG. 4.

By attaching multiple magnetic bodies 28 to the insulation member 25 upper and lower sides on their flanges' external surfaces, in FIG. 4 in the directions indicated by arrows B1 and B2 a magnetic flux can extend to provide a magnetic circuit to provide the function of a transformer. Since the magnetic body is provided in the form of a plate and thus stuck to the insulation member, it can be readily handled in fabricating a boosting transformer.

Figure 5:
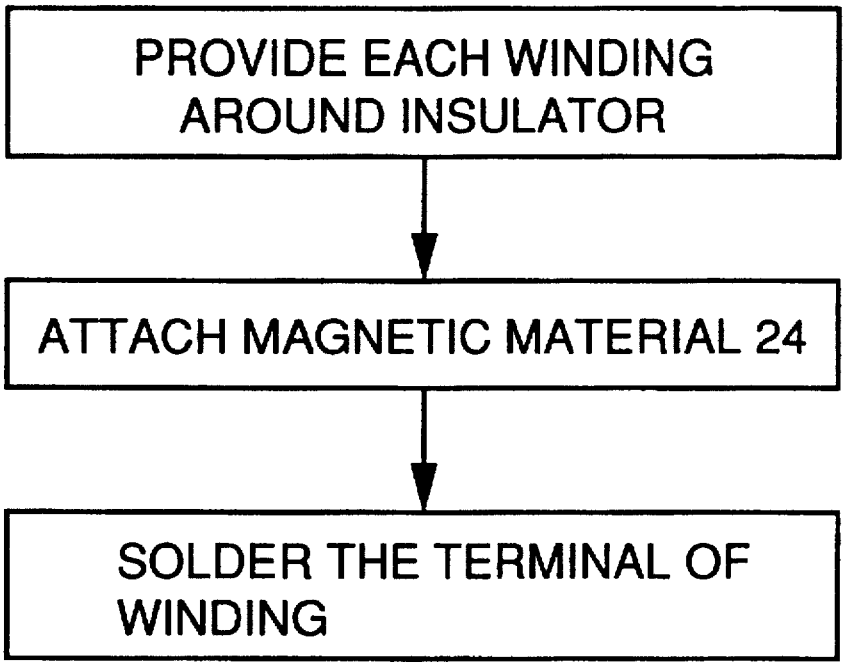
FIG. 5 is a flow chart of a procedure for providing the boosting transformer according to the third embodiment of the present invention.

Reference will now be made to FIG. 5 to describe a procedure of a process for producing the boosting transformer of the present embodiment.

In a first step, primary winding 20, secondary winding 21 and filament winding 23 are successively provided on insulation member 25.

In a second step, magnetic material 28 is attached to insulation member 25 on the upper and lower surfaces.

In a third step, a temporarily fixed terminal is soldered to complete a boosting transformer.

In the above, the first step and the second step may be switched.

As described above, in each embodiment configured as above a boosting transformer may be reduced in height to readily ensure a distance for insulating locations having therebetween a large potential difference from each other in the transformer's internal structure in designing a structure in which the transformer is attached to a high-frequency heating device. Thus the boosting transformer can be attached to the high-frequency heating device at a location less restrictively and such designing can be facilitated.

Furthermore in the second and third embodiments a boosting transformer may include an insulation member also serving as a magnetic body providing a magnetic circuit, to allow the boosting transformer to have a simplified configuration, resulting in an increased yield of such boosting transformer and a reduced cost for the same.

Fourth Embodiment

FIG. 6 shows a structure of a boosting transformer of a fourth embodiment of the present invention. As is apparent in comparison to the FIG. 2 structure of the first embodiment, the present embodiment, using a flat transformer and thus utilizing a high degree of magnetic coupling magnetic body 24 as indicated by an arrow E in FIG. 6, may eliminate an arm of magnetic body 24 that extends toward and circumscribes an perimeter of insulation member 25, i.e., an open end of a groove provided with a winding. As such, insulation member 26 in the first embodiment can be dispensed with, and magnetic body 24 may be attached to insulation member 25 before a winding is provided. Furthermore, if a winding is repaired, it can be repaired without removing magnetic body 24.

If magnetic body 24 does not extend toward or circumscribe the perimeter of insulation member 25, grounding magnetic body 24 with core fixing band 27, as in a twelfth embodiment (FIG. 15), would result in the transformer being increased in height H and diameter D. Furthermore, core fixing band 27 must be removed if a wiring needs repairing. Such disadvantage, however, can be overcome by the present embodiment, grounding magnetic body 24 via a spring plate 28 or pin provided at an inner wall of insulation member 25, as shown in FIG. 6, allowing the most use of the transformer of the present invention.

Fifth Embodiment

Figure 7:
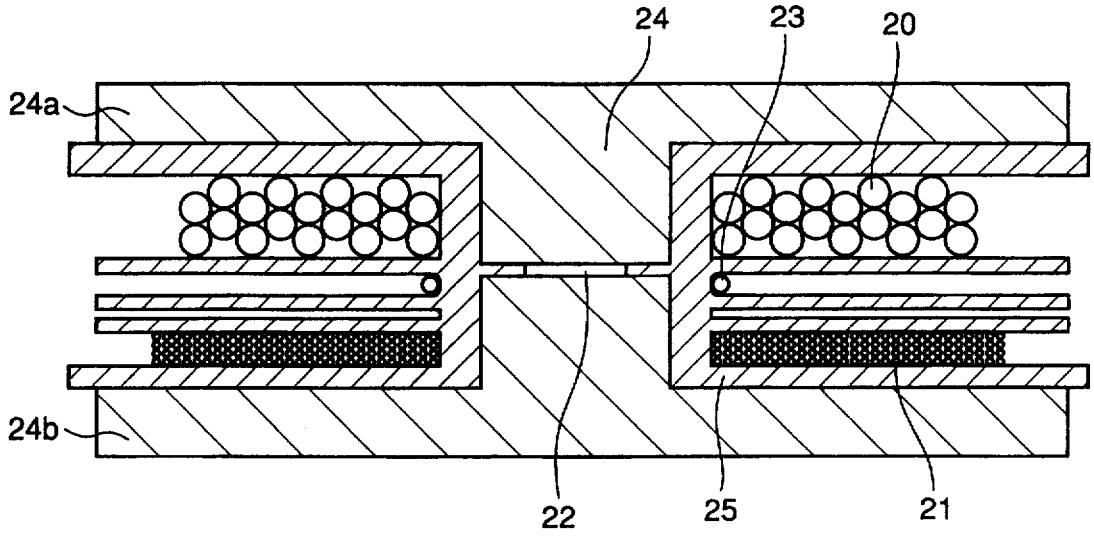
FIG. 7 is a cross section of a structure of a boosting transformer according to a fifth embodiment of the present invention.

FIG. 7 is a cross section of a boosting transformer of a fifth embodiment of the present invention, corresponding to the FIG. 6 boosting transformer of the fourth embodiment with magnetic body 24 having arms 24*a*, 24*b* extending from the center of a winding radially in multiple directions or provided in the form of a disc. As is apparent in comparison between FIGS. 6 and 7, in the present embodiment magnetic body 24 may have an arm thinner than in the fourth embodiment. As such, the transformer may further be reduced in height H. Furthermore, if magnetic body 24 is attached before a winding is provided, the winding can then be provided with a torque stabilized and it is thus hardly displaced.

Figure 17:
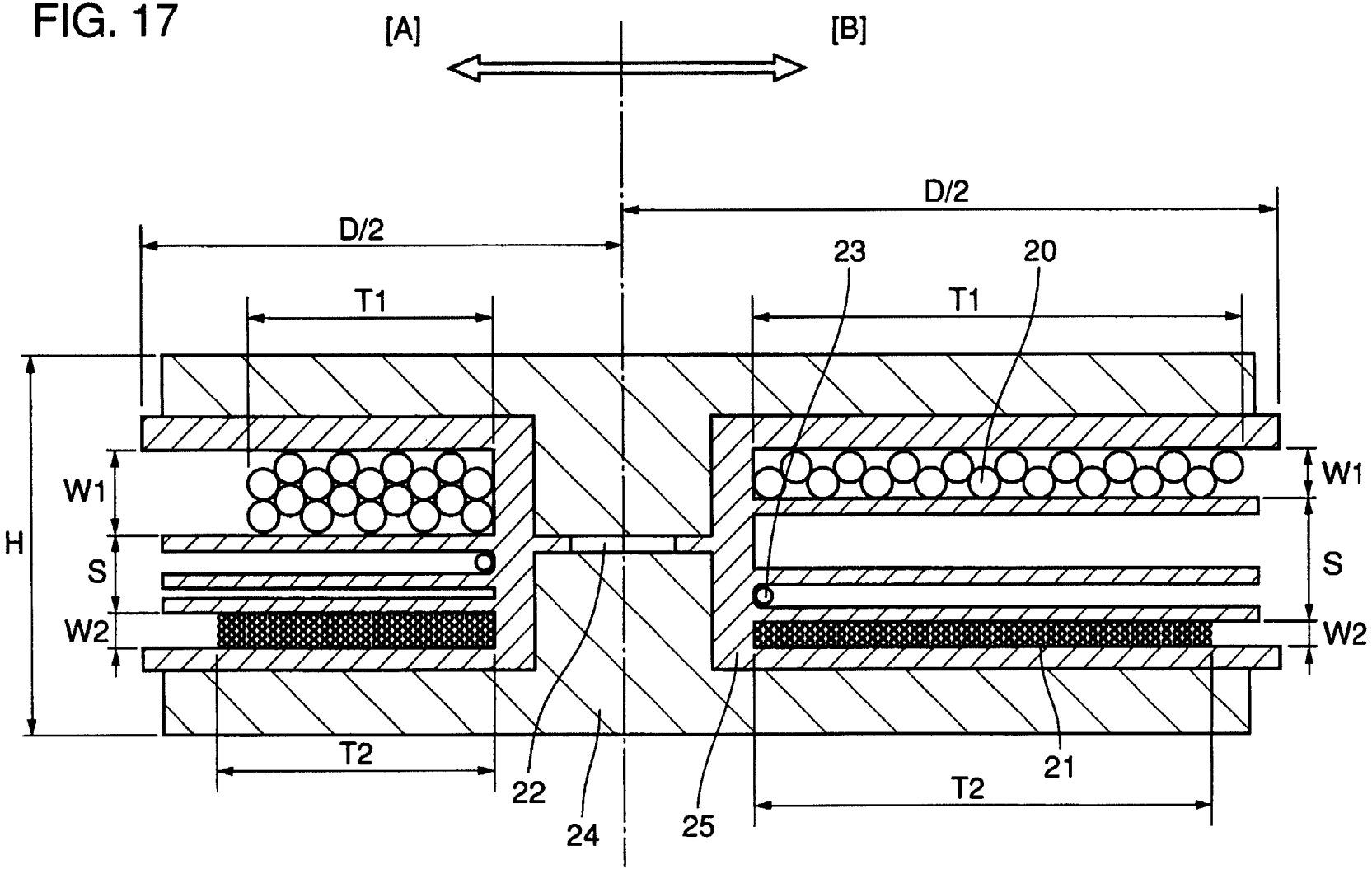
Figure 18:
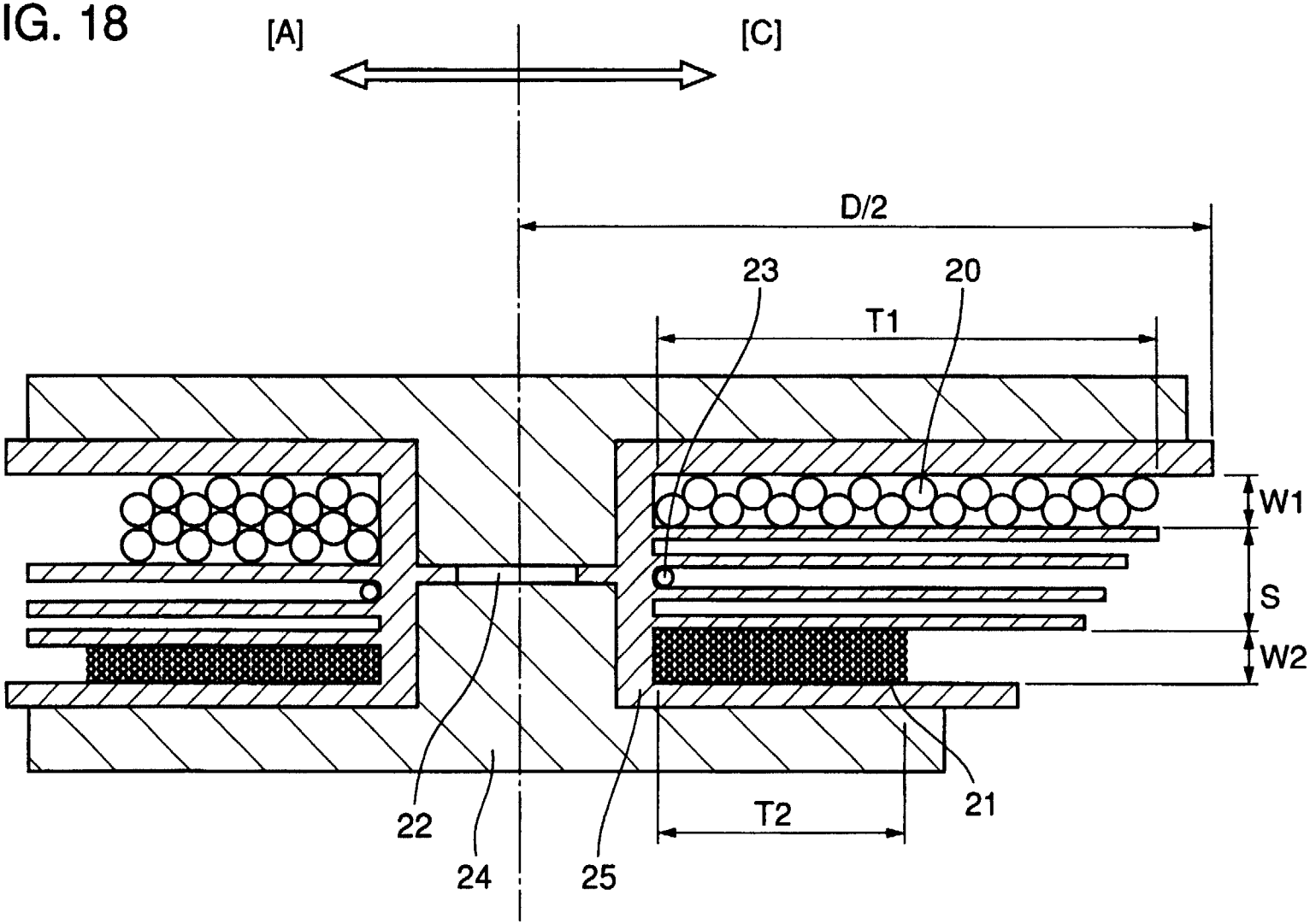
Figure 19:
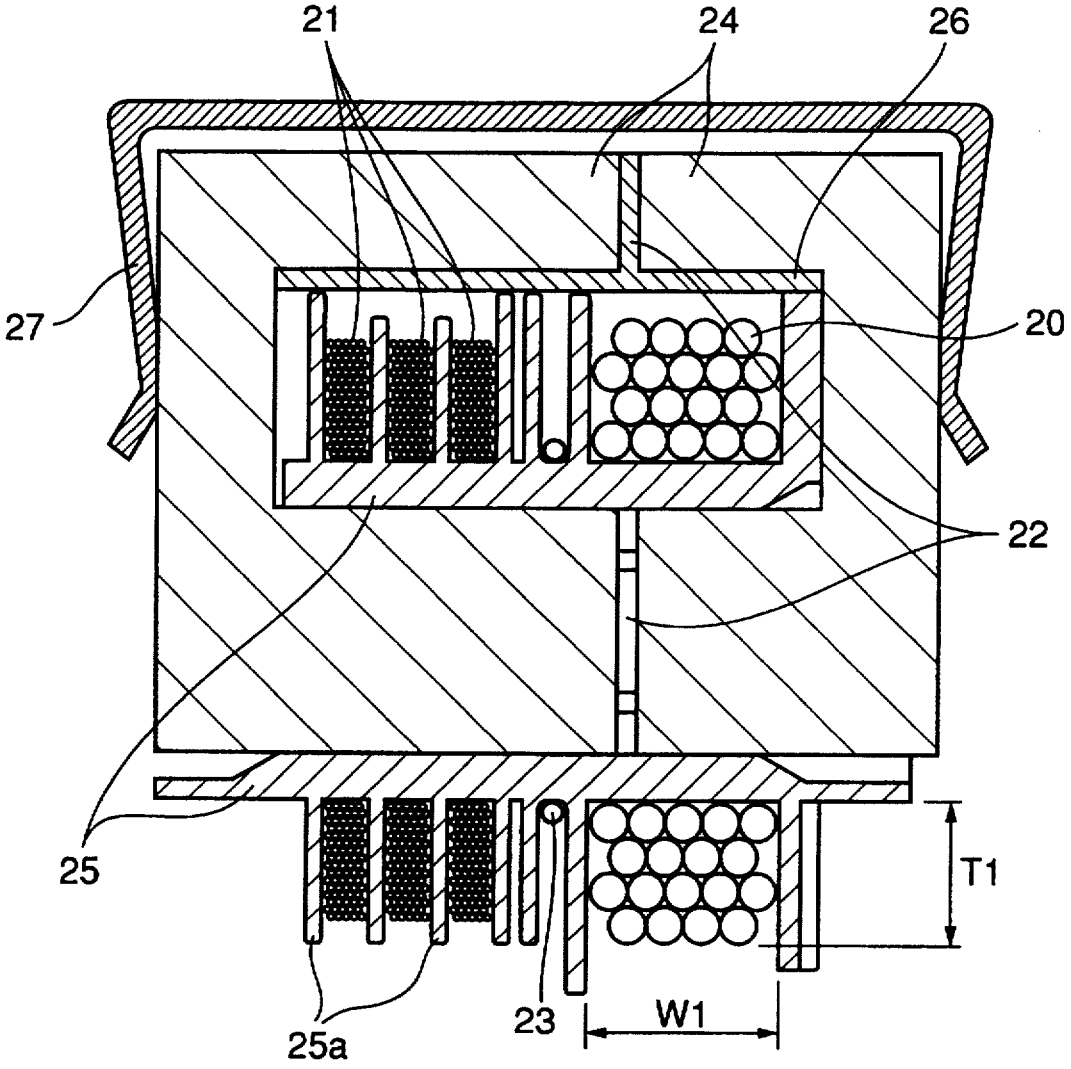
FIG. 19 PRIOR ART
FIG. 19 is a cross section of a conventional boosting transformer.
Figure 20:
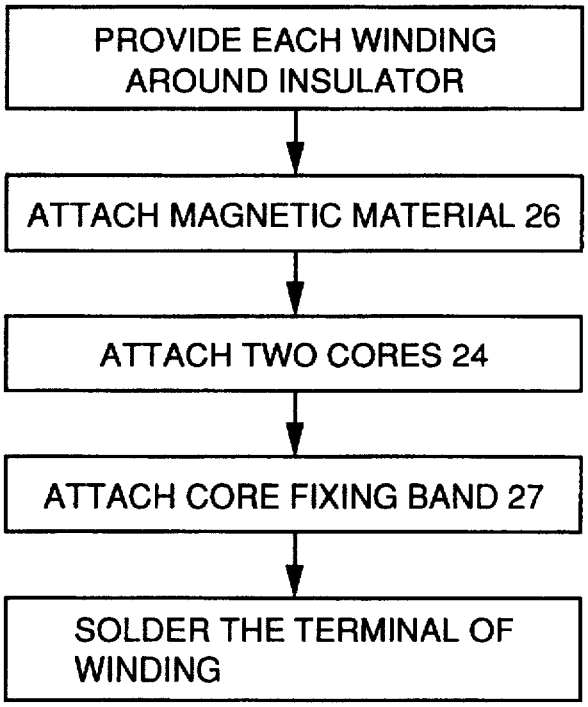
FIG. 20 PRIOR ART
FIG. 20 is a flow chart of a procedure for providing a conventional boosting transformer.
Figure 21:
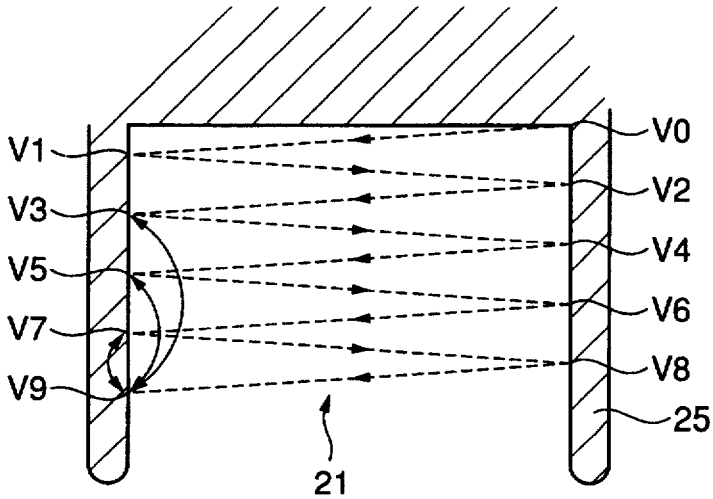
FIG. 21 PRIOR ART
FIG. 21 is a schematic, enlarged view for illustrating a secondary winding stacked stepwise and thus provided.

Reference will now be made to FIGS. 17 and 18 to describe in conjunction with a structure of the present embodiment a relationship between dimensions, such as the primary winding 20 thickness as measured when it is stacked T1 and width W1 and the secondary winding 21 thickness as measured when it is stacked T2 and width W2.

In FIGS. 17 and 18, the region on the left hand of the center line, a region [A], has a structure of the same size as in the FIG. 7 embodiment. In contrast, in FIGS. 17 and 18 the regions on the right hand of the center line, regions [B] and [C], are both structured with $^{T1}/_{W1}$ having a value of nine or more. As is apparent in comparison between regions [A] and [B] in FIG. 17, if $^{T1}/_{W1}$ has a value extremely increased then primary winding 20 and secondary winding 21 would be opposite to each other over too large an area, resulting in an extremely increased degree of magnetically coupling the windings together. As such, if such degree of coupling that is multiplied approximately by 0.65 to 0.8 is desired, then primary winding 20 and secondary winding 21 must have therebetween a distance spacing S them wide apart. Consequently, the transformer would not be so reduced in height H while it would be only increased in diameter D disadvantageously.

If a degree of magnetically coupling primary winding 20 and secondary winding 21 together is adjusted by providing secondary winding 21 having a thickness as measured when it is stacked T2 which is no more than approximately half the primary winding 20 thickness as measured when it is stacked T1, as shown in the FIG. 18 region [C], then distance S would be reduced, although secondary winding 21 would be increased in width W2. As a result, height H is not so reduced while width W2 is increased and secondary winding 21 would thus have an increased inter-layer voltage disadvantageously. Furthermore, while $^{T1}/_{W1}$ can have a value in a range of 1.0 to 1.5, primary winding 20 and secondary winding 21 are opposite to each other over a relatively small area and if their magnetic coupling degree is adjusted, as described above, then ferrite core 24 must be increased in size, which is disadvantageous in terms of cost.

As such, the primary winding 20 has a width (W1) and a thickness as measured when it is stacked (T1) in a relationship of $1.5<{}^{T1}/_{W1}<9$, and the secondary winding 21 has a thickness as measured when it is stacked (T2) approximately equal to T1, no less than 0.6T1 and no more than 1.5T1, and a width (W2) having a value determined depending on its winding diameter and turn-count, so that a boosting transformer for a high-frequency heating device can have a height H and a diameter D well-balanced and can also be reduced in thickness and also enhanced in performance and also economical.

Sixth to Ninth Embodiments

Figure 8:
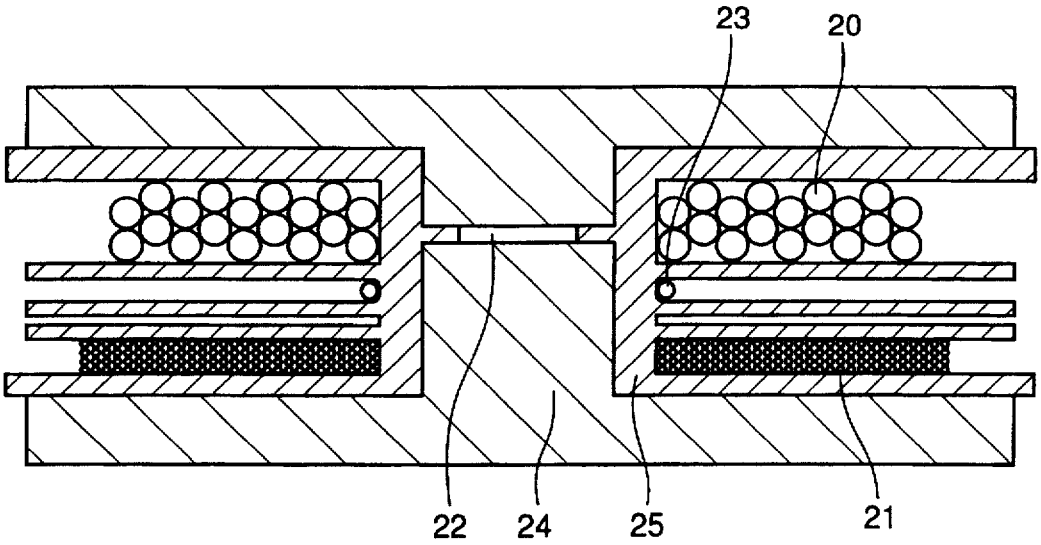
FIG. 8 is a cross section of a structure of a boosting transformer according to a sixth embodiment of the present invention.

FIG. 8 shows a structure of a boosting transformer of a sixth embodiment of the present invention, corresponding to the FIG. 7 boosting transformer of the fifth embodiment with its center gap altered in position.

Figure 9:
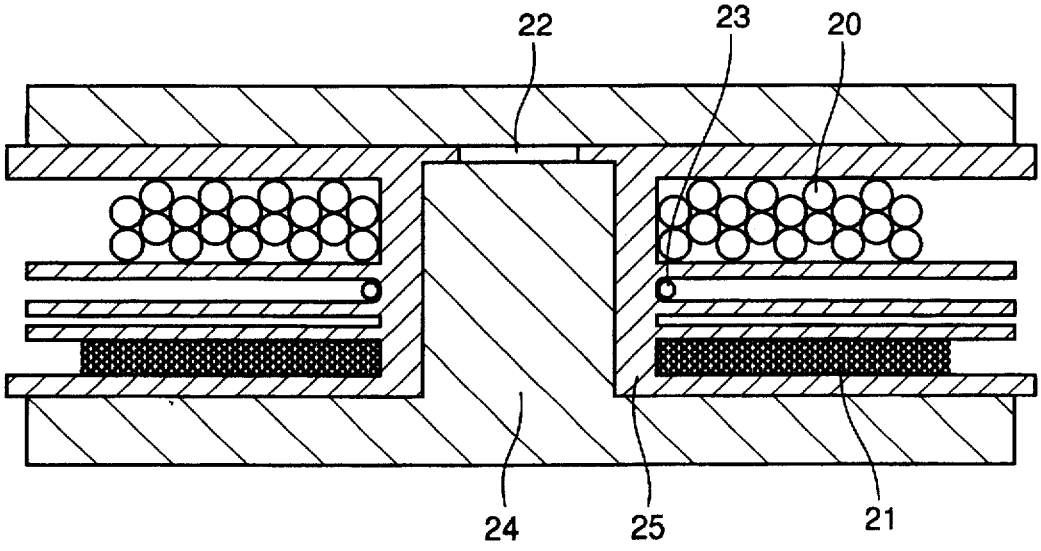
FIG. 9 is a cross section of a structure of a boosting transformer according to a seventh embodiment of the present invention.

FIG. 9 shows a structure of a boosting transformer of a seventh embodiment of the present invention, corresponding to the FIG. 7 boosting transformer of the fifth embodiment with a gap 22 altered in position. Such structures allow magnetic body 24 to be formed of a pair of magnetic pieces opposite to each other with gap 22 therebetween, one of which pieces may be provided in the form of a plate. Consequently, the magnetic body can be more readily shaped.

Figure 10:
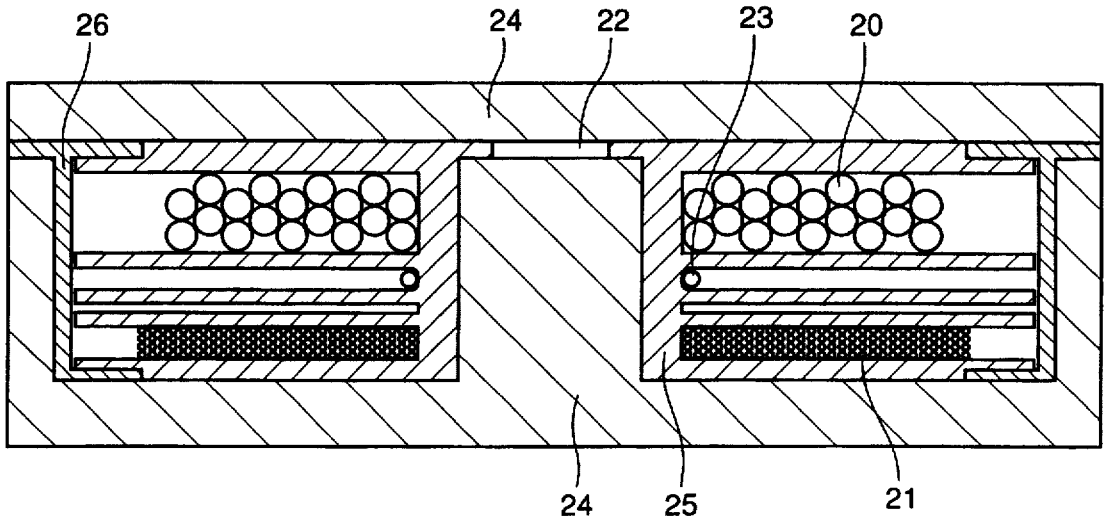
FIG. 10 is a cross section of a structure of a boosting transformer according to an eighth embodiment of the present invention.
Figure 11:
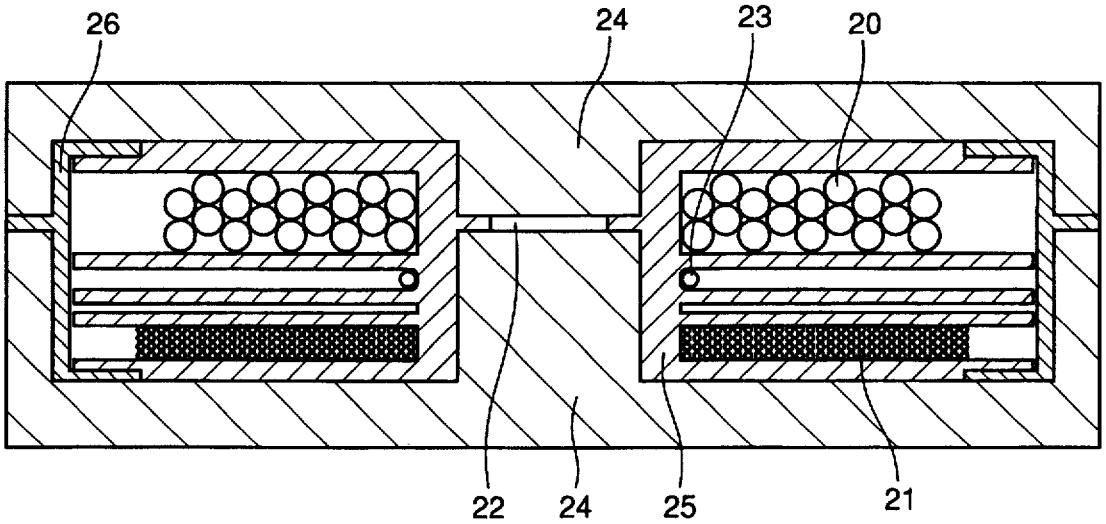
FIG. 11 is a cross section of a structure of a boosting transformer according to a ninth embodiment of the present invention.

FIG. 10 shows a boosting transformer of an eighth embodiment of the present invention, corresponding to the FIG. 2 boosting transformer of the first embodiment with magnetic body 24 varied to have a cross section in the E and I letters. FIG. 11 shows a boosting transformer of a ninth embodiment of the present invention, corresponding to the FIG. 2 boosting transformer of the first embodiment having magnetic body 24 with a pair of magnetic pieces each having an E-letter cross section and arranged opposite to each other.

Tenth Embodiment

Figure 12:
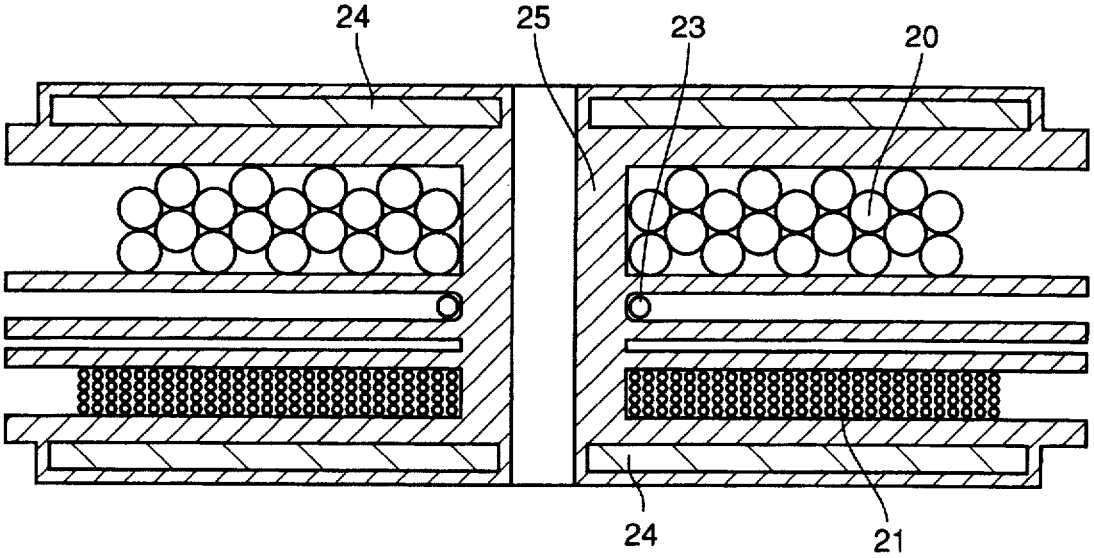
FIG. 12 is a cross section of a structure of a boosting transformer according to a tenth embodiment of the present invention.

FIG. 12 shows a boosting transformer of a tenth embodiment of the present invention, corresponding to the FIG. 4 boosting transformer of the third embodiment with magnetic body 24 buried in insulation member 25 for example by means of insertion-molding. Such structure allows magnetic body 24 of metal to be insulated. This can eliminate the necessity of grounding magnetic body 24 according to safety guidelines and the like and also eliminate the step of attaching the same. Furthermore, in the present embodiment magnetic body 24 can advantageously have a length different than in FIG. 4, as seen in the direction of the thickness of a winding as stacked, to adjust a degree of magnetically coupling primary winding 20 and secondary winding 21 together. As such, it is not necessary to adjust gap 22.

Figure 13:
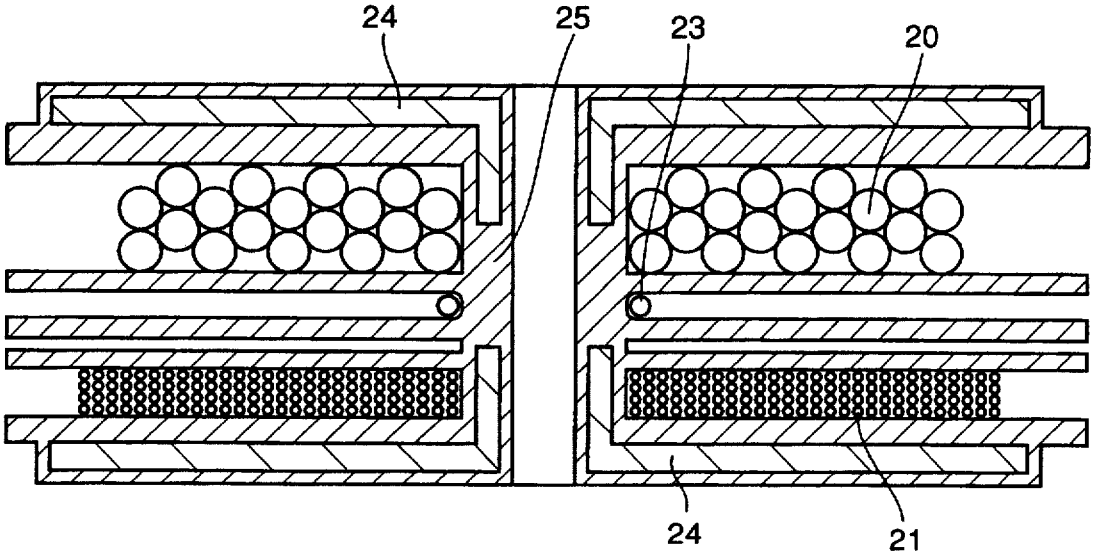
FIG. 13 is a cross section of a structure of a variation of the boosting transformer according to the tenth embodiment of the present invention.
Figure 14:
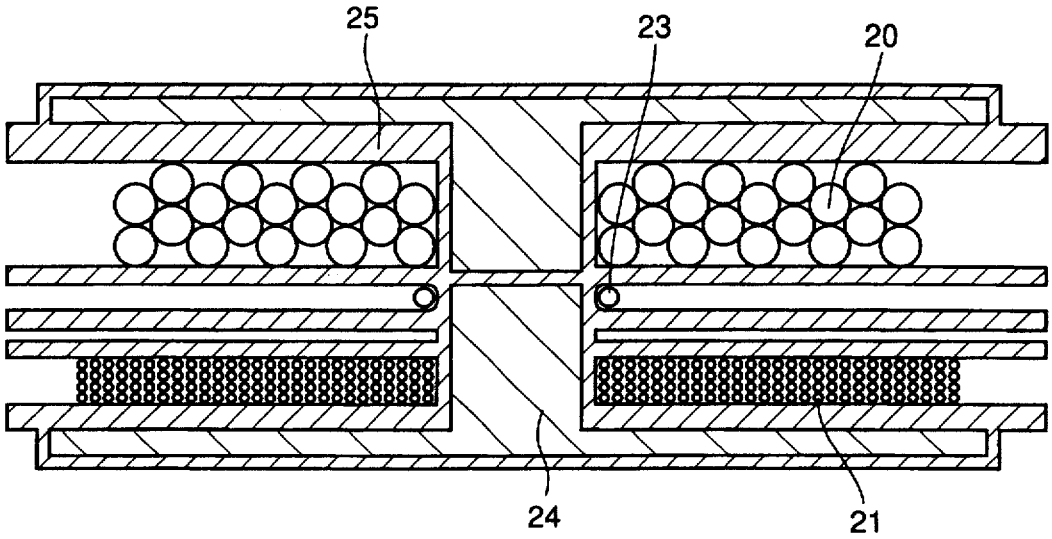
FIG. 14 is a cross section of a structure of another variation of the boosting transformer according to the tenth embodiment of the present invention.

FIGS. 13 and 14 shows boosting transformers as exemplary variations of the present embodiment, varying the shape of magnetic body 24 buried and thus formed by means of insertion-molding.

Twelfth Embodiment

Figure 15:
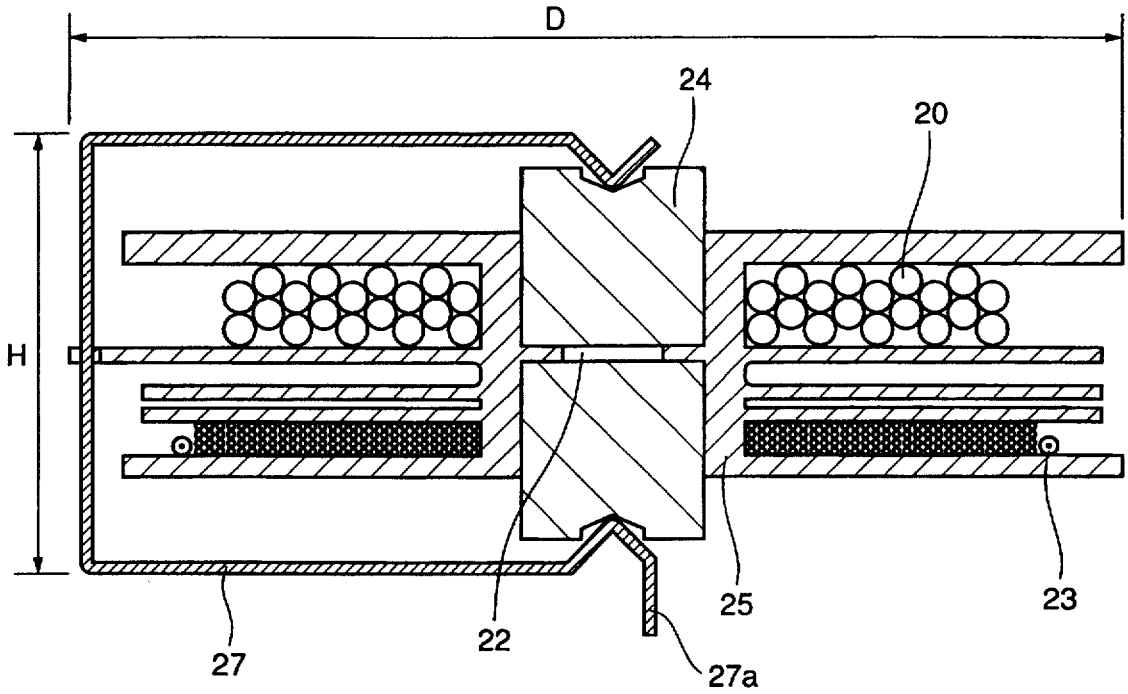
FIG. 15 is a cross section of a structure of a boosting transformer according to an eleventh embodiment of the present invention.
Figure 16:
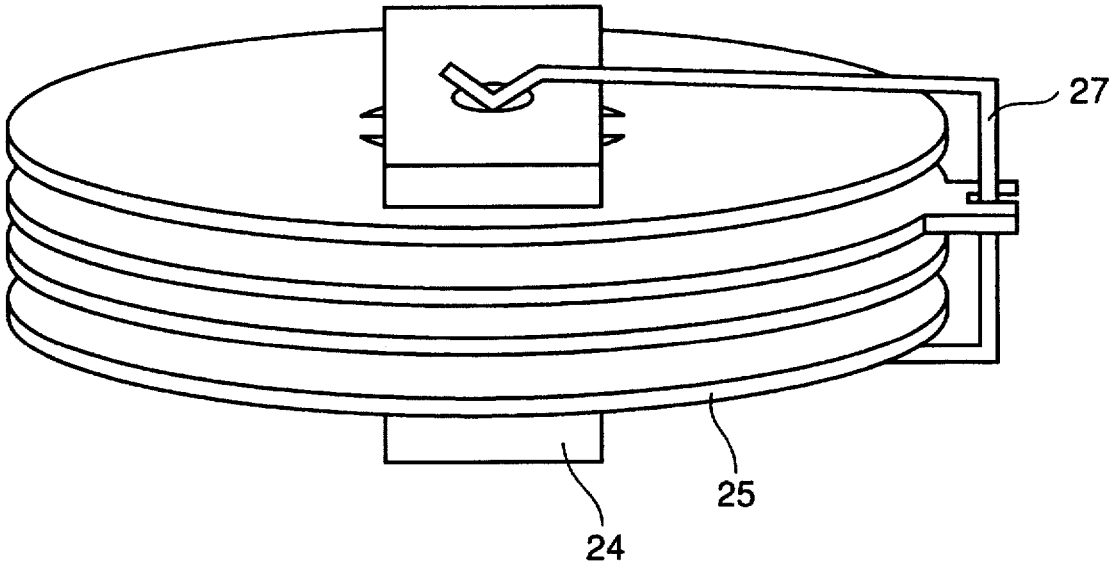
FIG. 16 is a perspective view of a general structure of the boosting transformer according to the eleventh embodiment of the present invention.

FIG. 15 is a cross section of a boosting transformer of an eleventh embodiment of the present invention, corresponding to the FIG. 7 boosting transformer of the fifth embodiment with magnetic body 24 fixed with core fixing band 27. FIG. 16 is a general, perspective view of a boosting transformer of the present embodiment. In the present embodiment, core fixing band 27 has a lower end 27*a* serving as a grounding pin.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A boosting transformer for a high-frequency heating apparatus, used in a high-frequency heating apparatus configured to rectify a commercial, alternating power supply to obtain a direct-current voltage in turn converted by an inverter circuit to a high-frequency voltage in turn boosted by a boosting transformer and thus fed to a magnetron, said boosting transformer comprising:

an insulation member; and a primary winding and a secondary winding formed at said insulation member and mutually insulated by said insulation member; wherein said primary winding and said secondary winding each have a width and a thickness as measured when each winding is stacked, said width being smaller than said thickness.

2. The boosting transformer of claim 1, wherein said secondary winding is not divided but provided in a single block.

3. The boosting transformer of claim 1, wherein said primary winding and said secondary winding are provided around said insulation member and accommodated respectively in two sets of spaces provided in said insulation member by a dividing wall of said insulation member.

4. The boosting transformer of claim 1, wherein said insulation member is provided in a form of a bobbin having a center with a throughhole passing therethrough and wherein said insulation member has an internal portion of said throughhole and a portion of an external surface thereof continuously surrounded by a magnetic substance for providing a magnetic circuit.

5. The boosting transformer of claim 1, wherein said insulation member has a magnetic material added thereto to serve as a magnetic substance providing a magnetic circuit.

6. The boosting transformer of claim 5, wherein said insulation member has an external surface with a magnetic substance added thereto.

7. The boosting transformer of claim 1, wherein said insulation member has an external surface with added thereto a magnetic substance providing a magnetic circuit.

8. The boosting transformer of claim 1, wherein said magnetic substance includes a ferrite core.

9. The boosting transformer of claim 1, wherein said primary winding has a width and a thickness as measured when said primary winding is stacked in a relationship of $1.5<T1/W1<9$, and said secondary winding has a thickness as measured when said secondary winding is stacked in a range of 0.6 T1 to 1.5 T1, and a width having a value determined depending on a winding diameter and turn-count of said secondary winding.

10. The boosting transformer of claim 4, wherein said magnetic substance dispenses with an arm extending toward and circumscribing an open end of a groove of said insulation member with a winding provided therein.

11. The boosting transformer of claim 4, wherein a degree of magnetically coupling said primary winding and said secondary winding together is adjusted depending on a length of magnetic substance in a direction of a thickness of a winding as stacked.

12. The boosting transformer of claim 4, wherein magnetic substance is grounded by either one of a plate spring and a pin provided at an inner wall of insulation member.

13. The boosting transformer of claim 4, wherein said magnetic substance is buried in said insulation member.

* * * * *